United States Patent [19]

Weber

[11] 4,444,154

[45] Apr. 24, 1984

[54] STEAM GENERATOR WITH FLUIDIZED BED FIRING

[75] Inventor: Anton Weber, Pfungen, Switzerland

[73] Assignee: Sulzer Brothers Limited, Winterthur, Switzerland

[21] Appl. No.: 365,551

[22] Filed: Apr. 5, 1982

[30] Foreign Application Priority Data

Apr. 23, 1981 [CH] Switzerland ..... 2651/81

[51] Int. Cl.[3] ..... B09B 3/00

[52] U.S. Cl. ..... 122/4 D; 110/245; 110/263

[58] Field of Search ..... 122/4 D, 235 K; 110/245, 263; 431/7, 170; 165/104.16

[56] References Cited

U.S. PATENT DOCUMENTS

| | | | |
|---|---|---|---|
| 3,648,666 | 3/1972 | Foldes et al. | 122/4 D |
| 4,183,330 | 1/1980 | Bryers et al. | 122/4 D |
| 4,184,455 | 1/1980 | Talmud et al. | 110/245 |
| 4,314,967 | 2/1982 | Kwon et al. | 431/170 |

*Primary Examiner*—Edward G. Favors
*Assistant Examiner*—Steven E. Warner
*Attorney, Agent, or Firm*—Kenyon & Kenyon

[57] ABSTRACT

The fluidized bed is situated in a combustion chamber formed from evaporator tubes welded in seal-tight relationship and leading into a gas flue. The combustion chamber is connected to the gas flue via two inclined connecting wall surfaces. Heater tubes bent into an L-shape extend through the fluidized bed. Each shorter limb of the heater tubes extends substantially vertically while the other longer limb extends substantially horizontally. The horizontal limbs pass through a substantially vertical combustion chamber wall at the level of the fluidized bed and the vertical limbs pass through the free surface of the fluidized bed beneath the connecting wall surface. As a result of this arrangement of the heater tubes, the stresses therein due to uneven thermal expansion of the heater tubes remain within permissible limits.

16 Claims, 6 Drawing Figures

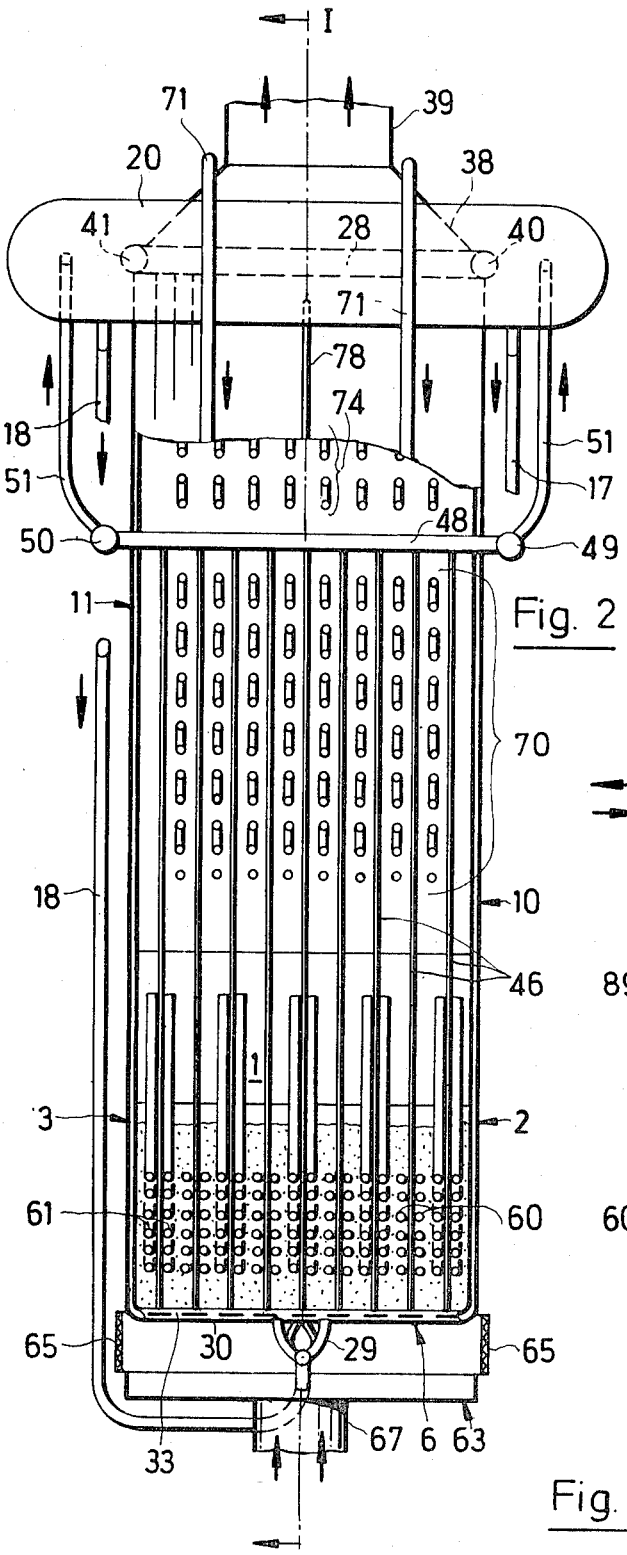
Fig. 2
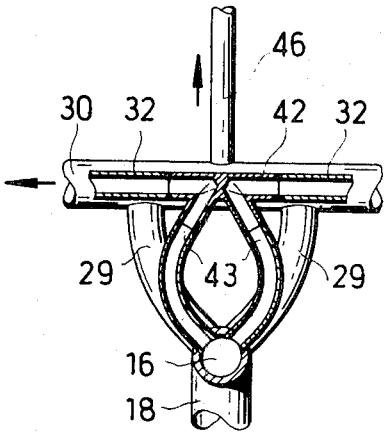
Fig. 4
Fig. 5
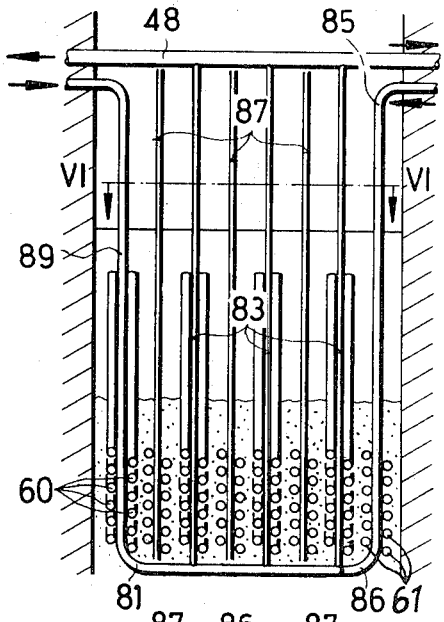
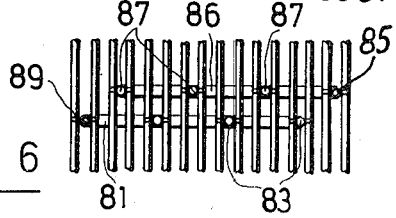
Fig. 6

STEAM GENERATOR WITH FLUIDIZED BED FIRING

This invention relates to a steam generator. More particularly, this invention relates to a steam generator with fluidized bed firing.

As is known, various types of steam generators have been constructed so as to function with a fluidized bed zone in which the combustion of a fuel may take place. For example, as described in published European Patent Application No. 0017657, one known steam generator has a fluidized bed zone in which a plurality of heater tubes are disposed in the form of tube coils which are bent to and fro to convey a gas. However, it has been found that when these heater tubes are in operation, particularly on starting up and running down, relatively high stresses due to uneven thermal expansion may occur in the tubes which cannot ultimately be withdstood by the tubes.

Accordingly, it is an object of the invention to provide a heated tube arrangement for a steam generator having a fluidized bed zone in which stresses due to thermal expansion are reduced.

It is another object of the invention to provide a relatively simple manner of reducing thermal stresses in the heated tubes of a steam generator having a fluidized bed combustion zone.

Briefly, the invention is directed to a steam generator which is comprised of a combustion chamber having a plurality of walls for defining a fluidized bed combustion zone and a gas flue of smaller cross-section above the combustion chamber. In accordance with the invention, at least one bunch of heater tubes of L-shape are disposed within the combustion chamber. In particular, each heater tube has a long limb extending substantially horizontally within the fluidized bed combustion zone and a shorter limb which extends substantially vertically within and through the combustion zone. A header is also connected to the heater tubes at one end while a collector is connected to the heater tubes at the opposite end.

Because of their short length, the vertical limbs have only a small differential expansion in relation to the combustion chamber wall. Hence, the long horizontal limbs can be supported without difficulty. Although the vertical limbs are short, these limbs deflect within permissible limits during variations in the length of the long limbs. Further, since the vertical limbs bear their own deadweight, the vertical limbs do not need to be supported. Instead, the vertical limbs carry a part of the weight of the horizontal limbs.

The stem generator is also constructed with at least one inclined wall surface which connects the combustion chamber with the flue. Further, the vertical limbs of the heater tubes pass through the connecting wall above the fluidized bed combustion zone and connect to a header located outside the combustion chamber. With this arrangement, the material stresses in the heater tubes are particularly favorable and accessible to calculation.

In addition, a plurality of vertical bearer tubes are provided in the steam generator for a cooling medium and for suspending the horizontal limbs of the heater tubes therefrom. This provides a very simple and reliable support of the horizontal limbs. Further, these bearer tubes may be connected to collector tubes which are located in the gas flue. This permits the elimination of separate bearer beams. Furthermore, the bearer tubes may form at least a preheater and/or evaporator for the steam generator. This affords a minimum differential expansion between the bearer tubes and the combustion chamber walls.

The combustion chamber may also be provided with a floor from which the bearer tubes extend upwardly. This provides a particularly simple arrangement in which the bearer tubes can form evaporator tubes in a natural circulation circuit.

The bearer tubes can be rigidly connected to the horizontal limbs of the heater tubes so that no sliding friction which may result in wear occurs at the bearing places. In this case, the bearer tubes are advantageously cooled by a forced circulation of a cooling medium. Further, the bearer tubes may be made as single U-tubes or the U-shaped tubes can be forked in the region of a reversal so that one down pipe would communicate with a plurality of risers. Also, instead of using a down pipe, a slightly sloping expansion loop may be used so that the bearer tubes can be de-watered when the steam generator is run down.

The steam generator may also be constructed so that collector tubes are connected to some of the bearer tubes and are located in the inclined wall surface connecting the combustion chamber to the gas flue. In this way, bearer tubes which might otherwise extend outside the steam generator for the heater tubes can be eliminated.

Advantageously, the heater tubes and bearer tubes may be constructed to form vertical tube panels. In this case, a plurality of the tube panels can be arranged so that the vertical limbs of the adjacent panels are situated on opposite sides of the combustion chamber. This considerably simplifies the construction of the steam generator since the places where the heated tubes pass through the combustion chamber wall and the connecting wall surfaces are less close together. Further, the headers and collectors for the heater tubes can be constructed with a smaller diameter.

Suitable guide means may also be provided for securing the tube panels against transverse deflection.

If the combustion air is heated from a temperature of from about 400° C. to about 800° C. within the heater tubes, it is advantageous to arrange the vertical limbs of the heater tubes as inlet limbs. In this case, the horizontal limbs are disposed downstream of the vertical limbs relative to the flow of medium therethrough. The thermal expansion of the vertical limbs thus remains closer to the thermal expansion of the combustion chamber wall. As a result, the distance between the apices of the heater tubes and the adjacent supporting points of the horizontal limbs can be made relatively short so that the flexural stresses are reduced in the region between the apex and the first support in each case of the associated horizontal limb. In addition, he lower temperature of the vertical limbs permits higher flexural stresses therein.

These and other objects and advantages of the invention will become more apparent from the following detailed description taken in conjunction with the accompanying drawings wherein:

FIG. 2 illustrates a view taken on line II—II of FIG. 1;

FIG. 4 illustrates a view taken on line IV—IV of FIG. 1;

FIG. 5 illustrates a cross-sectional view of a modified steam generator having a forced flow of working medium in the bearer tubes; and FIG. 6 illustrates a view taken on line VI—VI of FIG. 5.

Figure 1:
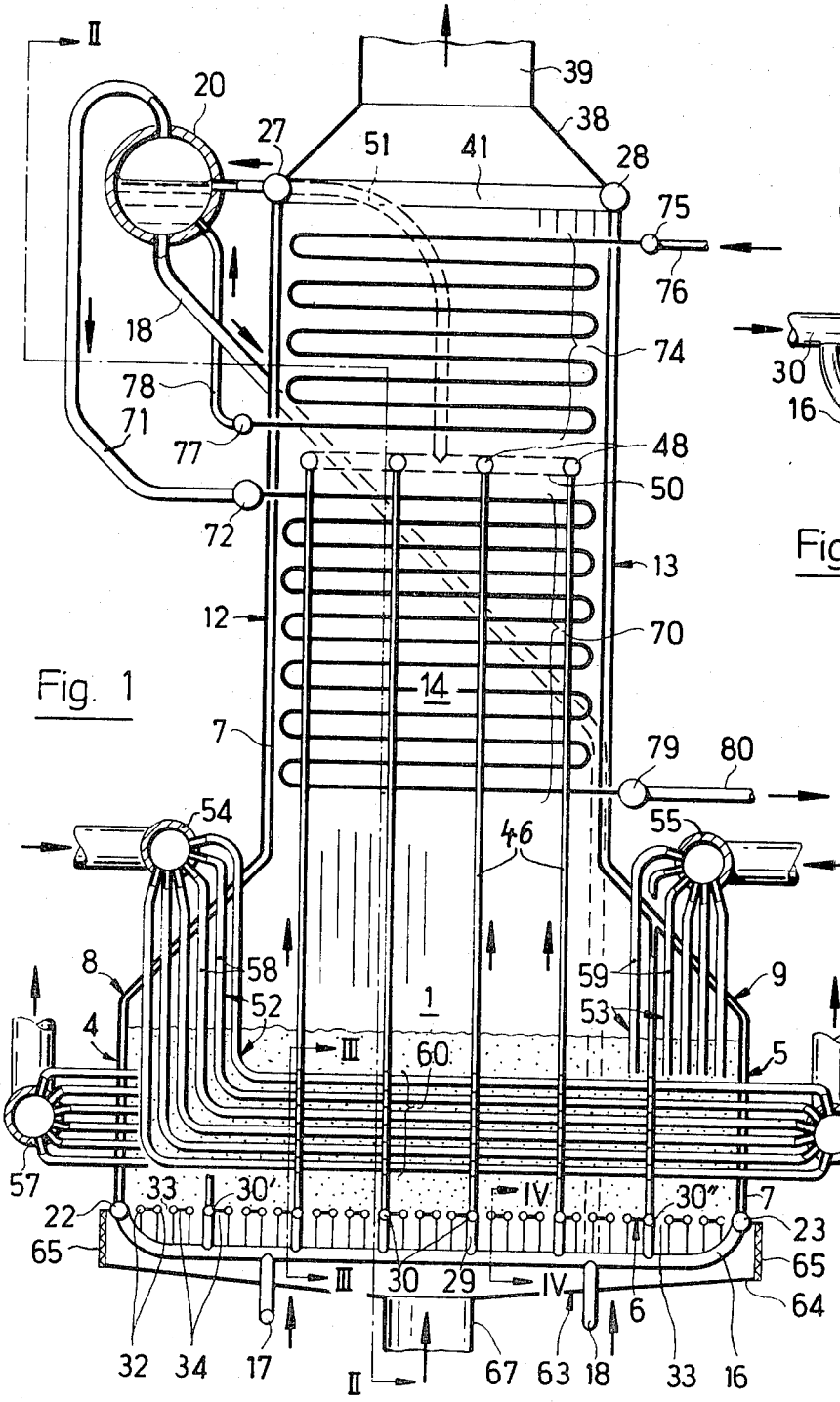
FIG. 1 illustrates a vertical sectional view through a natural circulation steam generator constructed in accordance with the invention.

Referring to FIG. 1, the steam generator includes a combustion chamber 1 of rectangular shape, as viewed in plan view. The combustion chamber 1 has a plurality of walls including a front wall 2, a back wall 3 (see FIG. 2) and two side walls 4, 5 and a floor 6 which forms the base area of the combustion chamber.

The steam generator also has a gas flue 14 of smaller cross-section than the combustion chamber 1 which is located above the combustion chamber 1. As indicated, the vertical walls 2, 3 of the combustion chamber 1 are connected in gas-tight relationship directly to vertical walls 10, 11 of the gas flue 14 while the side walls 4, 5 of the combustion chamber 1 are connected in gas-tight relationship to vertical walls 12, 13 of the gas flue 14 via two inclined connecting wall surfaces 8, 9, respectively.

The vertical walls 2–5 of the combustion chamber 1, the connecting wall surfaces 8, 9 and the vertical walls 10–13 of the gas flue 14 are each formed from a plurality of tubes 7 which are welded together in seal-tight relation.

A main header 16 extends centrally beneath the floor 6 of the combustion chamber 1 and is supplied with water in a substantially saturated state from a drum 20 via two down pipes 17, 18. The ends of the header 16 are each connected to a respective side wall header 22, 23 which is located at the foot of the respective side walls 4, 5. These headers 22, 23 are in turn connected to the tubes 7 of the side walls 4, 5 so as to convey working medium through the side walls 4, 5, the connecting wall surfaces 8, 9 and the side walls 12, 13 of the gas flue 14. The upper ends of the side walls 12, 13 terminate in side wall collectors 27, 28 respectively.

Figure 3:
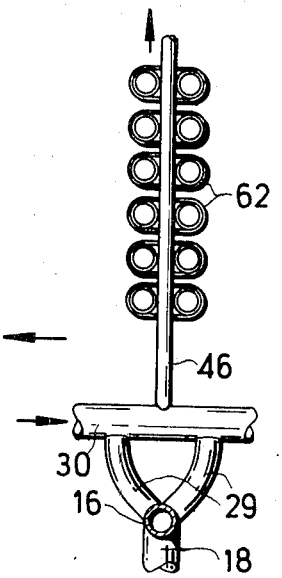
FIG. 3 illustrates a view taken on line III—III of FIG. 1 in an enlarged scale.

As indicated in FIG. 3, twelve curved connecting tubes 29 extend in pairs from the main header 16 to six bearer tube headers 30, 30', 30" in the floor 6 of the combustion chamber 1. In addition, the floor 6 is composed of floor tubes 32 which are connected to one another and to the adjacent headers 30, 30', 30" and 22, 23 via webs 34 so as to leave free passage apertures 33 between each two bearer tube headers 30 and between the side wall headers 22, 23 and adjacent bearer tube headers 30', 30", respectively. As shown in FIG. 4, each floor tube 32 is connected to the main header 16 via a K-piece 42 and two tube bends 43. The floor tubes 32 also lead into the tubes 7 which form the front wall 2 and back wall 3 of the combustion chamber 1. These tubes 7 further continue into the walls 10, 11 of the gas flue 14 and terminate in a front collector 40 and a rear collector 41 (see FIG. 2). The two collectors 40, 41 are connected to the side wall collectors 27, 28 while the collector 27 is connected to the drum 20 as shown in FIG. 1.

Referring to FIG. 2, a plurality of bearer tubes 46 branch off from the headers 30 at equal distances from one another and from the front and back walls 2, 3. These tubes 46 extend vertically upwards and lead into collectors 48 in the gas flue 14. These collectors 48 connect with transverse collectors 49, 50 which are disposed outside the flue 14 and which are, in turn, connected via connecting lines 51 to the drum 20.

As indicated in FIG. 1, the outermost two bearer tube headers 30' and 30" are situated beneath the connecting wall surfaces 8, 9. The bearer tubes 46 which extend from these headers 30', 30" each lead into a tube 7 of the inclined connecting wall surface 8, 9 located thereabove. Each of these latter tubes have a larger cross-section than the other tubes 7 of the side walls 4, 5, 12, 13 which extends upwardly from the point at which the bearer tubes 46 are connected.

Referring to FIG. 1, the combustion chamber 1 defines a fluidized bed combustion zone above the floor 6.

The steam generator also has a plurality of bunches of heater tubes disposed within the combustion chamber. Each bunch is formed of L-shaped heater tubes 52, 53, each of which has a long limb 60, 61 extending substantially horizontally within the fluidized bed combustion zone and a shorter limb 58, 59 extending substantially vertically within and through the combustion zone. As shown, each bunch of tubes 52, 53 extends from a respective header 54, 55 and leads to a respective collector 56, 57 and has the tubes aligned in vertical planes. The short vertical limbs 58, 59 extend through the inclined wall surfaces 8, 9 while the horizontal limbs 60, 61 extend through the side walls 5, 4, respectively. At the places where the limbs 58–61 pass through the walls, at least one of the tubes 7 of the side walls 4, 5 and the wall surfaces 8, 9 is conventionally bent out of the wall plane. Appropriately welded-in webs ensure that the walls are seal-tight at these passage places.

Referring to FIG. 1, the heater tubes 52, 53 are carried by the bearer tubes 46, for example at five places along the length of the long limbs 60, 61. As indicated in FIG. 3, U-shaped bearer loops 62 are used to secure each horizontal limb to a bear tube 46. As indicated, the loops are disposed symmetrically about the bearer tube 46.

As shown in FIG. 1, an air tank 63 is provided beneath the combustion chamber floor 6 and consists of a sheet metal trough 64 of rectangular contour which is connected to the periphery of the floor 6 in gas-tight relationship via expansion elements 65. An expansion element of this kind is described in Swiss Pat. No. 463,539. In addition, the air tank 63 is connected to a source of air for combustion (not shown) via a connection 67.

A superheater tube bunch 70 is provided in the gas flue 14 above the combustion chamber 1 and is connected at the top end as viewed, with a header 72. The header 72 is, in turn, connected via a pair of connecting lines 71 to a steam compartment in the drum 20. The bottom end of the superheater tube bunch 70 is connected via a collector 79 to a live steam line 80.

An economizer tube bunch 74 is also provided in the gas flue 14 above the superheater tube bunch 70. This economizer bunch 74 is connected to a header 75 outside the flue 14. The header 75, in turn, is connected to a feed line 76. An outlet of the economizer tube bunch 74 is formed by a collector 77 which is connected via a line 78 to a water compartment of the drum 20.

The upper end of the steam generator has a gas duct 39 which leads from the flue 14 to an air preheater (not shown). This gas duct 39 is connected via a sheet metal hopper 38 to the collectors 27, 28, 40, 41 disposed at the top end of the gas flue 14 and which form a ring main.

During operation, air is supplied to the steam generator via the connection 67 of the air tank 63. The air then rises through the free apertures 33 provided in the floor 6 of the combustion chamber 1. These apertures may be constructed, for example, as described in published European Patent Application 0019652. The air also flows upwardly through the fluidized bed combustion zone, for example a fluidized bed of coal, lime and slag particles. A very good heat transfer is obtained at the heater tubes 52, 53 by the contact of the glowing coal particles and the intensive turbulence of the combustion gases. A third medium, preferably air, flows in the heater tubes 52, 53 although the medium may be one in which a chemical process takes place. In this latter case, the heater tubes 52, 53 may contain catalysts or may be internally coated with catalysts. Of course, the heater tubes 52, 53 can be connected in series instead of in parallel, for example by connecting the collector 56 to the header 55.

During operation, feed water enters the steam generator via the feed line 76. This water is then preheated to almost evaporation temperature in the economizer tube bunch 74 and is fed to the drum 20. Water then passes from the drum 20 via the down pipes 17, 18 into the main header 16 beneath the floor 6 of the combustion chamber 1.

A first batch of water flows from the header 16 via the side walls headers 22, 23 into the tubes 7 of the side walls 4, 5 and then passes as a steam and water mixture into the drum 20 via the side walls 12, 13 and side walls collectors 27, 28.

A second batch of water flows from the main header 16 via the tube bends 43, K-pieces 42 and floor tubes 32 into the tubes 7 of the front and rear walls 2, 3. The water then flows, on the one hand, via collectors (not shown) disposed along the inclined outer edges of the connecting wall surfaces 8, 9 and via risers (not shown) 40 the collectors 40, 41 and, on the other hand, as a mixture of steam and water to the collectors 40, 41. Thereafter, this mixture flows to the drum 20 via the side wall collector 27.

A third batch of water flows from the main header 16 into the bearer tubes 46 and acts as a cooling medium. The steam and water mixture forming therein then flows via the bearer tube collectors 48, transverse collectors 49, 50 and connecting lines 51 into the drum 20.

Saturated steam from the steam compartment of the drum 20 flows via the connecting lines 71 into the superheater tube bunch 70. After being superheated, the steam flows into the live steam line 80 which leads, for example to a steam using load (not shown).

The above-described steam generator may form part of an installation, for example as described in published European Patent Application No. 0017657. In this case, air of a temperature of, for example, 400° C. is heated to 800° C. in the heater tubes 52, 53 and is fed as a working medium to a gas turbine. The relatively high temperature of the air in the horizontal limbs 60, 61 of the heater tubes 52, 53 causes these limbs to expand considerably during operation. During expansion, the limbs 60, 61 slide in the U-shaped loops 62 (see FIG. 3). Hence, it may be advantageous to provide the inside of the loops 62 and/or the outside of the limbs 60, 61 in the region of the loops 62 with an agent which prevents or reduces wear. For example, the agent may be applied by plasma spraying.

During operation, the vertical limbs 58, 59 of the heater tubes 52, 53 assume a much lower temperature than the horizontal limbs. This is because the vertical limbs 58, 59 have colder air flowing there through and because the vertical limbs are partially heated only by flue gas which gives a lesser heat transfer on the heating medium side. Accordingly, the apices between the short and long limbs move practically only horizontally in relation to the tubes of the side walls 4, 5. Since the temperatures in these tubes are substantially the same as in the bearer tubes 46, the points of support of the heater tubes 52, 53 remain at approximately the same height in relation to the passage places. The heater tube suspension can therefore be said to be ideal.

Referring to FIG. 2, the heater tubes 52, 53 are supported on each of the bearer tubes 46 at the same heights on either side. These heater tubes also start from the same headers 54, 55, respectively, and lead to the same collectors 56, 57, respectively. Five such bearer tubes together with twelve heater tubes 52 or 53 fixed thereon form a tube panel. In addition, consecutive tube panels are alternated so that the vertical limbs are on opposite sides of the combustion chamber 1. That is, the vertical limbs 58 of the heater tubes 52 are adjacent the side wall 4 while the vertical limbs 59 of the heater tubes 53 are adjacent the side wall 5 (see FIG. 1). It may be advantageous if the heater tubes 52, 53 supported on different sides of the same bearer tube 46 are so connected to the headers 54, 55 and the collectors 56, 57 so that the heater tubes of one side are connected to the header 54 and the collector 56 and the heater tubes of the other side are connected to the header 55 and the collector 57. Thus, during expansion, the frictional forces acting on the bearer tubes 46 substantially compensate one another and produce only relatively controllable turning moments.

In order to reduce the effect of friction, the bearer tubes may be constructed as pendulums. In this case, the bearer tubes are fed via flexible tubes, such as down pipes. In addition, the bearer tubes may be in the form of single U-tube loops or loops which may be branched. For example, as shown in FIGS. 5 and 6, a down pipe 89 which carries twelve heater tubes 52 from a header 54 (not shown) leads, in each case to a horizontal tube 81 from which three risers 83 branch. Each riser 83 also carries twelve heater tubes 52 from the header 54 (not shown) and leads into a bearer tube collector 48. A down pipe 85 is disposed in parallel to this bearer system and is offset laterally by one bearer tube pitch. The down pipe 85 also carries twelve heater tubes 53 from the header 55 (not shown) and leads via a horizontal tube 86 to three risers 87. Each riser 87 also carries twelve heater tubes 53 from the header 55 (not shown) and leads to a collector.

The construction shown in FIGS. 5 and 6 allows the bearer tubes 89, 83 and 85, 87 to perform opposite pendulum movements corresponding to the expansion of the long limbs 60, 61. Any friction is thus avoided.

If the long limbs 60, 61 of the heater tubes are suspended at five places as indicated in FIG. 1 but in the form of pendulums, four such bearer system pairs must be provided with a single bearer system beneath each of the connecting wall surfaces 8, 9.

It may be advantageous for the pendulum bearer systems to be guided laterally, for example, on an evaporator tube grid located above or below the long limbs of the heater tubes or on vertical partitions near the combustion chamber floor 6. Such partitions may also serve, if required, to divide the combustion chamber into compartments. This is particularly important for part-load operation.

The bearer tube collectors 48 need not be disposed between the economizer tube bunch 74 and superheater tube bunch 70 as indicated in FIG. 1. Instead, the bearer tube collectors 48 may be disposed in the region of the superheater or even beneath the superheater. In this latter case, it may be advantageous for the deep-hanging bearer tube collectors to be supported by higher-hanging collectors via a small number of bearer tubes. Such a support may alternatively be provided by high points of the gas flue walls via inclined tubes.

As indicated in FIG. 5, the heater tubes 52, 53 are secured on the respective bearer tubes 89, 83 and 85, 87 in an offset arrangement.

The steam generator may also be constructed such that the headers 54, 55 are disposed at the inlet of the heater tubes 52, 53 inside the combustion chamber 1, that is, between the free fluidized bed surface and the connecting wall surfaces 8, 9. The number of passages through the associated connecting wall surfaces 8, 9 can thus be greatly reduced. However, the disadvantage of such an arrangement is that the material stresses in the region of the heater tube connections are less well known and less accessible to calculation than the arrangement illustrated in FIG. 1. As a compromise, intermediate headers may be provided inside the combustion chamber 1.

The steam generator may also be provided with suitable means for introducing the fuel, preferably in granular form and possibly with aggregates, in order to form a fluidized bed and/or fix noxious substances, for example lime for fixing sulphur. The steam generator may also include means for discharging and/or recycling fuel, aggregates and/or recycling products.

The invention thus provides a steam generator of the fluidized bed type which can be constructed with panels of heater tubes which do not undergo excessive stressing during operation. Further, the tube panels can be readily constructed and installed due to a simple shape.

What is claimed is:

1. A steam generator comprising a combustion chamber having a plurality of walls for defining a fluidized bed combustion zone, said walls including a plurality of evaporation tubes secured together in seal-tight relation;

a gas flue of smaller cross-section than said combustion chamber above said combustion chamber;

at least one inclined wall surface connecting said combustion chamber with said flue;

at least one bunch of heater tubes, each said heater tube being of L-shape having a long and shorter limb, said long limb extending substantially horizontally within said fluidized bed combustion zone and through a vertical combustion chamber wall and said shorter limb extending substantially vertically within and through said combustion zone;

a header connected to said heater tubes at one end outside said combustion zone; and a collector connected to said heater tubes at an opposite end outside said combustion zone.

2. A steam generator as set forth in claim 1 wherein said vertical limbs pass through said inclined wall surface above said fluidized bed combustion zone and are connected to said header.

3. A steam generator as set forth in claim 1 which further comprises a plurality of vertical bearer tubes for a cooling medium suspending said horizontal limbs therefrom.

4. A steam generator as set forth in claim 3 which further comprises collector tubes connected in common to at least some of said bearer tubes and located in said gas flue.

5. A steam generator as set forth in claim 4 wherein said bearer tubes form at least one of a feed water preheater and evaporator.

6. A steam generator as set forth in claim 4 wherein said combustion chamber has a plurality of tubes connected to each other to form a floor and said bearer tubes extend upwardly from said floor.

7. A steam generator as set forth in claim 3 wherein said bearer tubes are U-shaped with vertical limbs.

8. A steam generator as set forth in claim 3 which further comprises collector tubes connected to some of said bearer tubes and located in said inclined wall surface.

9. A steam generator as set forth in claim 3 wherein a group of said heater tubes and a plurality of said bearer tubes form a vertical tube panel.

10. A steam generator as set forth in claim 9 having a plurality of said vertical tube panels with said vertical limbs of adjacent tube panels being situated on opposite sides of said combustion chamber.

11. A steam generator as set forth in claim 10 which further comprises guide means for securing said tube panels against transverse deflection.

12. A steam generator as set forth in claim 1 wherein said horizontal limbs are disposed downstream of said vertical limbs relative to a flow of medium therethrough.

13. A steam generator comprising a combustion chamber having a plurality of walls for defining a fluidized bed combustion zone;

a gas flue of smaller cross-section than said combustion chamber above said combustion chamber;

at least one inclined wall surface connecting said combustion chamber with said flue;

at least one bunch of heater tubes, each said heater tube being of L-shape having a long and shorter limb, said long limb extending substantially horizontally within said fluidized bed combustion zone and said shorter limb extending substantially vertically within and through said combustion zone;

a header connected to said heater tubes at one end outside said combustion zone; and a collector connected to said heater tubes at an opposite end.

14. A steam generator as set forth in claim 13 wherein said header is connected to said vertical limbs and said collector is connected to said horizontal limbs.

15. A steam generator as set forth in claim 14 wherein said vertical limbs pass through said inclined wall surface and said header is located outside said combustion chamber.

16. A steam generator as set forth in claim 14 wherein said collector is located outside said combustion chamber and said horizontal limbs extend through a wall of said combustion chamber.

* * * * *